US007508645B2

(12) United States Patent
Trivette et al.

(10) Patent No.: US 7,508,645 B2
(45) Date of Patent: Mar. 24, 2009

(54) METHOD AND APPARATUS FOR OPERATING A MAGNETIC ACTUATOR IN A POWER SWITCHING DEVICE

(75) Inventors: Marty L. Trivette, Cary, NC (US); Erskine R. Barbour, Benson, NC (US); Bryan A. Shang, Raleigh, NC (US)

(73) Assignee: ABB Technology AG, Zurich (CH)

( * ) Notice: Subject to any disclaimer, the term of this patent is extended or adjusted under 35 U.S.C. 154(b) by 360 days.

(21) Appl. No.: 11/177,151

(22) Filed: Jul. 9, 2005

(65) Prior Publication Data

US 2006/0007623 A1 Jan. 12, 2006

Related U.S. Application Data

(60) Provisional application No. 60/586,764, filed on Jul. 9, 2004.

(51) Int. Cl.
*H01H 47/04* (2006.01)
*H01H 47/32* (2006.01)

(52) U.S. Cl. ..... 361/139; 361/154; 361/152; 361/194

(58) Field of Classification Search ..... 361/139, 361/154, 152, 194
See application file for complete search history.

(56) References Cited

U.S. PATENT DOCUMENTS 3,018,421 A * 1/1962 Hodgson ..... 361/160
3,238,992 A * 3/1966 Forbes ..... 236/21 R
4,225,898 A * 9/1980 Weber et al. ..... 361/154
4,720,763 A 1/1988 Bauer
4,729,056 A * 3/1988 Edwards et al. ..... 361/153
4,922,878 A * 5/1990 Shinogle et al. ..... 123/490
5,128,825 A 7/1992 Hurley et al.
5,205,129 A * 4/1993 Wright et al. ..... 62/68
5,237,262 A * 8/1993 Ashley et al. ..... 323/284
5,347,419 A * 9/1994 Caron et al. ..... 361/154
5,471,823 A * 12/1995 Panoushek et al. ..... 56/10.2 E (Continued)

FOREIGN PATENT DOCUMENTS

EP 306839 * 1/1988

(Continued)

OTHER PUBLICATIONS

The Authoritative Dictionary of IEEE Standard Terms 2000, IEEE Press, pp. 935.*

(Continued)

*Primary Examiner*—Stephen W Jackson
*Assistant Examiner*—Zeev Kitov
(74) *Attorney, Agent, or Firm*—Paul R. Katterle; Bryan A. Shang

(57) ABSTRACT

A method and apparatus for operating a magnetic actuator in a power switching device by transmitting at least two different electrical current waveforms to the actuator. Both waveforms are sent to the actuator from a controller in the same direction to move an actuator's armature from a first position to a second position. The first current waveform causes the armature to move from the first position to the second position. The second waveform is transmitted to the actuator to keep the armature moving towards the second position without overdriving the armature.

16 Claims, 10 Drawing Sheets

U.S. PATENT DOCUMENTS 5,546,268 A * 8/1996 Hurley et al. ..... 361/154
5,579,194 A * 11/1996 Mackenzie et al. ..... 361/24
5,784,244 A 7/1998 Moran et al.
5,914,849 A 6/1999 Perreira
6,005,757 A * 12/1999 Shvach et al. ..... 361/64
6,038,516 A * 3/2000 Alexander et al. ..... 702/67
6,291,911 B1 9/2001 Dunk et al.
6,331,687 B1 12/2001 Dunk et al.
2003/0123212 A1 7/2003 Dunk et al.

FOREIGN PATENT DOCUMENTS

EP 0 440 498 8/1991

OTHER PUBLICATIONS

IPRP—PCT/US2005/024236, Jan. 9, 2007, Trivette et al.
ISA—PCT/US2005/024236, Feb. 16, 2006, Trivette et al.

* cited by examiner

METHOD AND APPARATUS FOR OPERATING A MAGNETIC ACTUATOR IN A POWER SWITCHING DEVICE

CROSS REFERENCE TO RELATED APPLICATION

This application claims the priority of U.S. provisional patent application Ser. No. 60/586,764 filed on Jul. 9, 2004, entitled "System and Method of Configuring and Controlling Latching Actuators Used In Power Systems," the contents of which are relied upon and incorporated herein by reference in their entirety, and the benefit of priority under 35 U.S.C. 119(e) is hereby claimed.

FIELD OF THE INVENTION

The present invention relates to a power switching device and more particularly to an actuator used in a power switching device.

BACKGROUND OF THE INVENTION

In the power generation and distribution industry, utility companies generate electricity and distribute the electricity to customers. To facilitate the process of distributing electricity, various types of power switching devices are used. In a distribution circuit, electricity flows through the power switching devices from a power generation source (typically a substation or the like) to the consumer. When a fault is detected in the distribution circuit, the power switching device is opened and the electrical connection is broken.

Within the power switching device, a magnetic actuator (hereinafter referred to as an "actuator") is used to provide the mechanical means of opening and closing the distribution circuit. The movement of the actuator pushes or pulls a moveable electrical contact towards or away from a stationary contact. When the electrical contacts touch, the circuit is closed and electricity flows through the power switching device. When the actuator pulls the moveable electrical contact away from the stationary contact, the flow of electricity through the power switching device is interrupted and the circuit is opened. The motion of the moveable contact is in the same direction as the motion of the actuator. This type of actuator is typically referred to as a linear actuator.

Controllers are used by the utility company to detect faults that occur in the distribution circuit. This type of controller typically uses a microprocessor programmed to respond to the fault based on the type of fault and the type of power switching device connected to the controller. The controller may respond to a particular fault by causing the power switching device to remain open. Alternatively, upon the detection of a fault, the controller may cause the power switching device to open and close multiple times.

The controller sends an electrical waveform to a coil in the actuator in one direction to open the distribution circuit and in the opposite direction to close the distribution circuit. The electrical waveform may be a continuous DC waveform or a modulated waveform. If a continuous DC waveform is applied to an open power switching device, the moveable contact starts to accelerate and continues to accelerate up to the point of contact. This causes the moveable contact to slam into the stationary contact with such force that the contacts bounce apart and arcing occurs. Alternatively, a modulated waveform as described in U.S. Pat. No. 6,331,687 may be used. Another way of operating a linear actuator is described in U.S. Pat. No. 6,836,121.

The controller may be programmed from the factory with a default modulated waveform characteristic (amplitude and duration). Alternatively, the modulated waveform may be programmed in the field by a utility craftsperson. The craftsperson uses an interface to the controller to select a preprogrammed waveform to be applied to the coil of the actuator. The prior art modulated waveforms used to control the actuator are of a fixed amplitude and duration throughout the operation of the actuator.

Instead of selecting from a set of standard modulated waveforms, the present invention allows a user to program a specific amplitude and duration for the modulated waveform used to control the actuator coil. The present invention also allows the craftsperson to program a variety of waveforms to be sent to the actuator. One set of waveforms is applied to the coil of the actuator before the moveable contact is set in motion. Another set of waveforms is applied while the moveable contact is in motion, and yet another set of waveforms is applied when the moveable contact has stopped moving. The present invention also allows the controller to automatically modify the user programmed waveforms based on real time operating conditions at the power switching device.

SUMMARY OF THE INVENTION

A method of operating an actuator used in a power switching device is disclosed. The method:

provides a controller;

transmits a first electrical current waveform in a first direction from the controller to an actuator, the actuator having an armature movable between a first position and a second position in response to the first electrical current waveform; and, transmits a second electrical current waveform in the first direction from the controller to the actuator, wherein the second electrical current waveform is different than the first electrical current waveform.

An actuator for use in a power switching device is disclosed. The actuator having an armature, the armature moving from a first position towards a second position in response to a first electrical current waveform transmitted in a first direction to the actuator, the actuator receiving a second electrical current waveform transmitted in the first direction, the second electrical current waveform being different than the first electrical current waveform.

A power switching device is disclosed. The power switching device having an actuator which has an armature, the armature moving from a first position towards a second position in response to a first electrical current waveform transmitted in a first direction to the actuator, the actuator receiving a second electrical current waveform transmitted in the first direction, the second electrical current waveform being different than the first electrical current waveform.

BRIEF DESCRIPTION OF THE DRAWINGS

The invention is further described in the detailed description that follows, by reference to the noted drawings by way of non-limiting illustrative embodiments of the invention, in which like reference numerals represent similar elements throughout the several views of the drawings, and wherein.

DETAILED DESCRIPTION OF ILLUSTRATIVE EMBODIMENTS

Figure 1A:
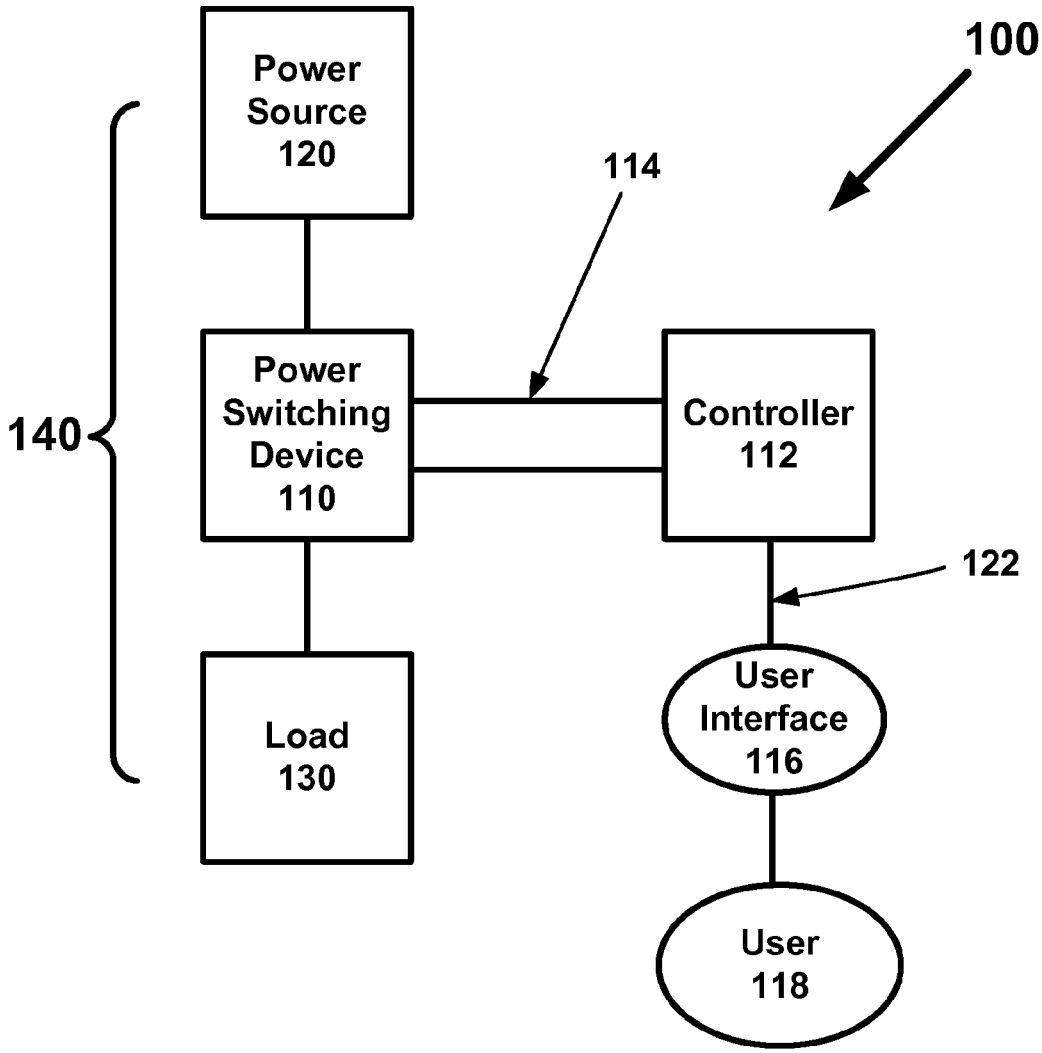
FIG. 1A illustrates a block diagram of a typical power switching configuration.

FIG. 1A shows a block diagram of a typical power switching configuration 100. The power switching configuration 100 has a power switching device 110 which is connected in series between a power source 120 and a load 130. The electrical circuit between the power source 120 and the load 130 is referred to as the power distribution circuit 140. The power switching device 110 is connected to a controller 112 by a bidirectional communications bus 114. A user 118 programs the controller 112 as well as receives information from the controller 112 via a user interface 116. The user interface 116 connects to the controller 112 through a communication means 122.

Figure 1B:
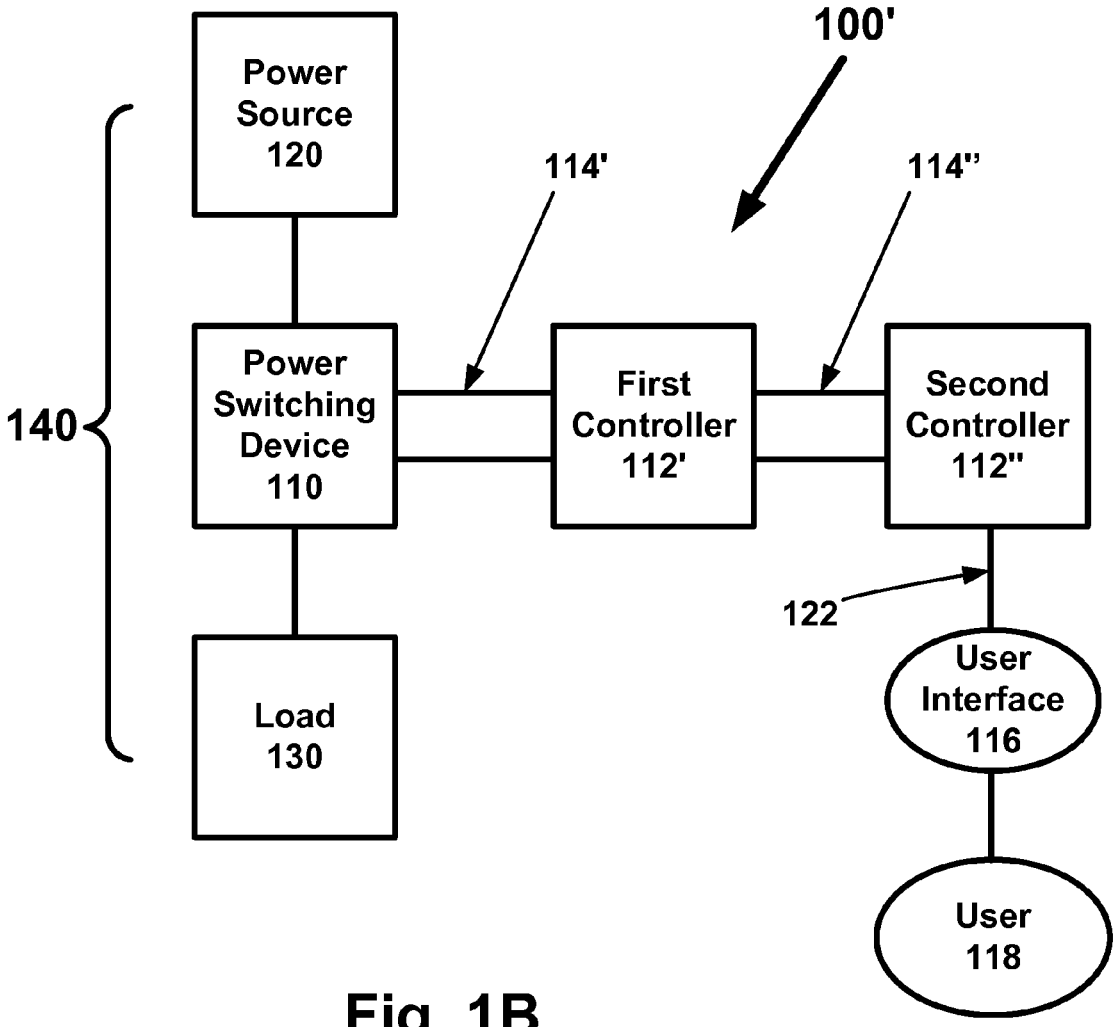
FIG. 1B illustrates a block diagram of an alternative power switching configuration.

An alternative power switching configuration 100' is illustrated in FIG. 1B. The power switching configuration 100' uses two controllers 112' and 112" connected in tandem to control the power switching device 110. The first controller 112' directly controls the power switching device 110. The second controller 112" provides instructions to the first controller 112'. The first bidirectional communications bus 114' connects the first controller 112' to the power switching device 110, and the second bidirectional communications bus 114" connects the first controller 112' to the second controller 112". Information from the power switching device 110 is relayed by first controller 112' to the second controller 112". In the alternate powers witching configuration 100', the user 118 programs and receives information from the second controller 112" via the user interface 116. The user interface 116 connects to the second controller 112" through the communication means 122.

In the configurations 100 and 100' the power switching device 110 connects the power source 120 to the load 130. A power source 120 used with the present invention is a distribution substation that provides, for example, a 15 kV-38 kV source of three phase AC power. An individual transformer or bank of transformers connected together comprises the load 130. The transformers may be three phase transformers for large industrial applications or single phase transformers used to provide electricity to a residential consumer.

While the following description is discussed with reference to FIG. 1A, it is equally applicable to FIG. 1B. Three types of power switching devices 110 that utility companies use in the power switching configuration 100 are fault interrupters, breakers and reclosers. Each power switching device 110 performs a preprogrammed response when a fault condition in the power distribution circuit 140 is detected by the controller 112. For example, the fault interrupter opens once and remains open when a fault condition is detected. The breaker opens after a fault, but attempts to close before remaining open if the fault continues to exist. A recloser opens and closes multiple times when a fault condition exists. By opening and closing multiple times, the recloser attempts to clear the fault. Should the fault condition continue to exist, the recloser opens and remains open until reset manually. When the recloser remains open it is considered to be in a "lock out" state.

A fault condition occurs when either one phase of power becomes shorted to ground, phases become shorted to each other, or when lightning strikes the distribution circuit 140. When a fault condition occurs, large amounts of current flow through the power distribution circuit 140. The controller 112 monitors the voltage and current levels sent by the power switching device 110. The power switching device 110 routes the voltage and current signals to the controller 112 through the bidirectional communications bus 114. When an abnormal current level is detected by the controller 112, the controller 112 signals the power switching device 110 to execute the preprogrammed response. The controller 112 monitors the voltage levels at the power switching device 110 and displays this information to the user 118 via the user interface 116. The voltage level information assists the user 118 to determine if the power switching device 110 is able to be brought back on line after a lock out state.

The controller 112 is programmed by the user 118 through the user interface 116. In one embodiment of the present invention, the user interface 116 is a PC (desktop or laptop) running the Windows™ Operating System with an associated application software package such as WINPCD, WINISD, or AFSuite™, offered by ABB Inc. The user 118 programs the controller 112 with information such as fault thresholds, type of power switching device 110, and the preprogrammed response the power switching device 110 is to perform when a fault occurs.

A user 118 may be the utility craftsperson who is at the power switching device location. The craftsperson can use a laptop PC as the user interface 116 and connect directly to a serial port on the controller 112. The connection to the serial port is the communication means 122. Another user 118 may be the utility maintenance person remotely logged into the controller 112. In this example, the remotely located utility maintenance person uses a desktop PC for the user interface 116 and a modem as the communication means 122 to connect to the controller 112. Examples of information passed to the user 118 from the controller 112 are the number of times a fault was detected in the power distribution circuit 140, the type of fault, and the present status of the power switching device 110.

Figure 2:
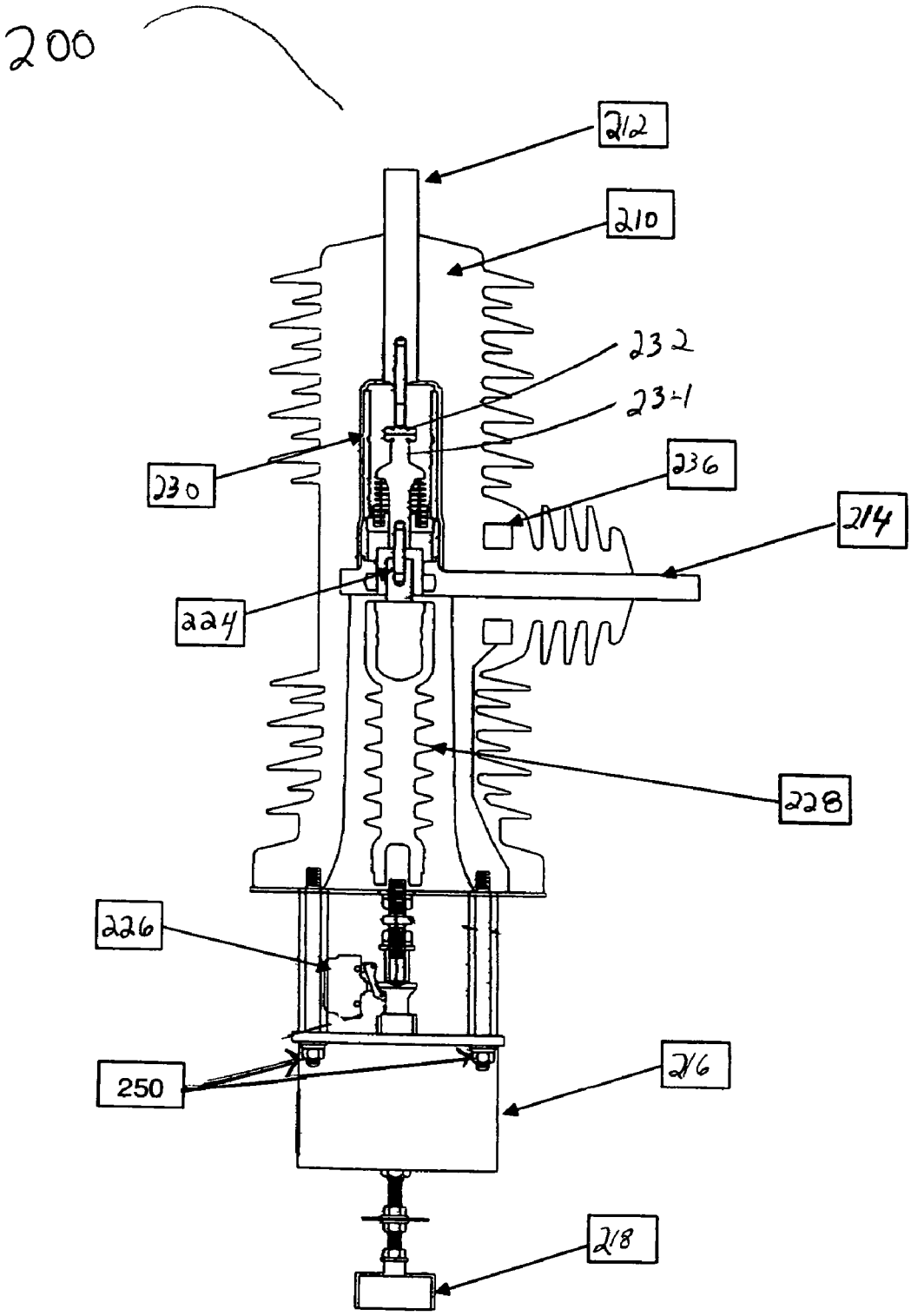
FIG. 2 illustrates a cross sectional view of a recloser used in the power generation and distribution industry.

A cross sectional view of a typical power switching device 110 in the form of a recloser 200 such as the OVR 1 Single Phase Recloser manufactured as of the filing of the U.S. patent application by ABB Inc. is illustrated in FIG. 2. The recloser 200 is typically mounted to a high voltage cabinet (not shown). Once attached to the high voltage cabinet, a housing 210 protrudes outside the high voltage cabinet. In a three phase application, three single phase reclosers are lined up together, all mounted on the high voltage cabinet. The controller 112 may be installed within the high voltage cabinet, but in most cases, the controller 112 is installed in a separate low voltage cabinet (not shown).

Current flows through the recloser 200 from an H1 connector 212, through a vacuum interrupter 230 and a current transfer assembly 224 to an H2 connector 214. The vacuum interrupter 230 provides an enclosure that houses a stationary contact 232 and a moveable contact 234. The stationary contact 232 is directly connected to the H1 connector 212. The current transfer assembly 224 provides the electrical connection between the moveable contact 234 and the H2 connector 214.

Mounted around the H2 connector 214 is a current transformer 236. The current transformer 236 is used to monitor the amount of current flowing through the recloser 200. The vacuum interrupter 230, the current transfer assembly 224, the current transformer 236, and portions of the H1 and H2 connector 212, 214 are enclosed in the housing 210.

An operating rod 228 located within the housing 210 connects the vacuum interrupter 230 to an actuator 216. The actuator 216 moves the operating rod 228 up or down which in turn closes or opens the electrical connection between the stationary contact 232 and a moveable contact 234. A micro switch 226 and a visual position indicator 218 are attached to the actuator 216. The micro switch 226 provides an electrical indication of the position of the actuator 216 to the controller 112. The visual position indicator 218 provides a visual indication of the position of the actuator 216 at the device location. The actuator 216 is secured to the housing by fastening bolts 250.

The H1 connector 212 connects the recloser 200 to the power source 120 and connector H2 214 connects the recloser 200 to the load 130. When the stationary contact 232 and the moveable contact 234 are touching, the connection between the H1 connector 212 and the H2 connector 214 is closed and current is flowing. When the moveable contact 234 separates from the stationary contact 232, the path between the H1 connector 212 and the H2 connector 214 opens and current ceases to flow.

The vacuum pressure in the vacuum interrupter 230 minimizes arcing associated with the joining of the moveable contact 234 with the stationary contact 232. The vacuum pressure also minimizes arcing when the two contacts 232, 234 separate. The vacuum interrupter 230 uses a pressure bellows (not shown) to maintain the integrity of the vacuum during the movement of the moveable contact 234.

The actuator 216 is used to provide the mechanical means to separate or join the contacts 232, 234. To open the recloser 200, the actuator 216 pulls the operating rod 228 downward which causes the moveable contact 234 to move away from the stationary contact 232. To close the recloser 200, the actuator 216 pushes the operating rod 228 upward, causing the moveable contact 234 to move toward the stationary contact 232 until the two contacts 232, 234 join.

As is well known in the art, arcing between the contacts 232, 234 is reduced by driving the contacts apart or together quickly. However, when the velocity of the moveable contact 234 is too great when the contacts 232, 234 join, the moveable contact 234 bounces off the stationary contact 232 causing an arc. The bouncing of the moveable contact 234 also introduces transients into the power distribution circuit 140. When bouncing occurs, the contacts 232, 234 sustain damage and the lifespan of the recloser 200 is adversely affected. Thus, it is desirable for the moveable contact 234 to join with the stationary contact 232 quickly without bouncing.

Figures 3A, 3B, 3C:
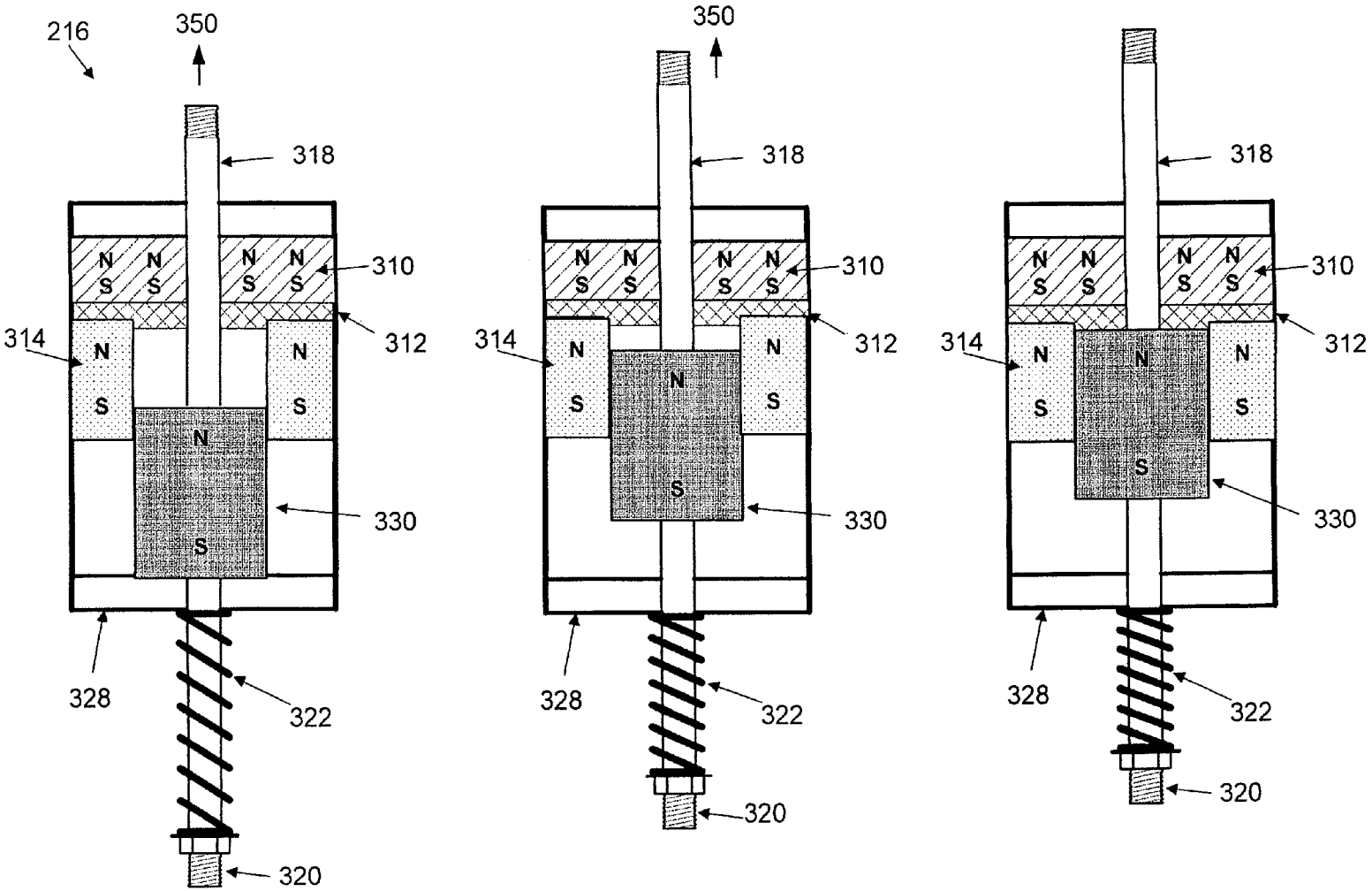
FIG. 3A illustrates an actuator of a power switching device in an open position prior to moving to a closed position.
FIG. 3B illustrates the actuator moving from the open position to the closed position.
FIG. 3C illustrates the actuator in the closed position after completing the closing cycle.

FIG. 3A shows a cross sectional view of an actuator 216, used in the recloser 200, in an open position. The actuator 216 has a permanent magnet 310, a buffer plate 312, a coil 314 and an armature 330, all enclosed within an actuator housing 328. The armature 330 is attached to an upper actuator rod 318 which is connected to the operating rod 228. Below the armature 330, is a lower actuator rod 320. An opening spring 322 is mounted around the lower actuator rod 320. The lower actuator rod 320 is also connected to the visual position indicator 218. The north pole of the permanent magnet 310 is oriented in the upward direction 350 while the south pole of the permanent magnet 310 is oriented towards the buffer plate 312.

In order to move the actuator 216 from an open position to a closed position, sufficient closing force must be applied to the armature 330 to drive it towards the permanent magnet 310. The closing force must also be sufficient enough to move the armature 330 through the opposing force applied by the opening spring 322. The closing force is developed by applying an electrical current to the coil 314 through coil leads (not shown). When current flows through the coil 314, a magnetic field forms around the coil 314. The orientation of the magnetic field surrounding the coil 314 depends on the direction of the current flowing through the coil 314. When current is flowing in a first direction, the north portion of the magnetic field around the coil 314 is oriented, as shown in FIG. 3A, in the upward direction 350. As the magnetic field intensifies it magnetically polarizes the armature 330 with the orientation of the north pole of the armature 330 in the upward direction 350. As the magnetic polarization of the armature 330 grows, the north pole of the armature 330 becomes more attracted to the south pole of the permanent magnet 310. Once the magnetism of the armature 330 has reached a sufficient strength the attraction of the south pole of the permanent magnet 310 to the north pole of the polarized armature 330 causes the armature 330 to move upwards 350.

FIG. 3B shows the actuator 216 moving from the open position to the closed position. The attractive magnetic force applied to the armature 330 has started the armature 330 moving towards the permanent magnet 310. The movement of the armature 330 and rods 318 and 320 cause the opening spring 322 to compress. Ideally, the motion of the armature 330 is at its maximum velocity during this stage. After the actuator 216 moves through the position shown in FIG. 3B, the contacts 232, 234 are touching or are just about to touch.

In FIG. 3C, the actuator 216 is in the closed position. When the actuator 216 is in the closed position, the armature 330 rests against the buffer plate 312 and the opening spring 322 is in a fully compressed state. The buffer plate 312 provides a layer of protection between the armature 330 and the permanent magnet 310 and prevents the permanent magnet 310 from sustaining damage from the armature 330. When the actuator 216 has reached the closed position, electrical current in the first direction continues to be supplied to the coil 314 of the actuator 216. By continuing to apply current to the coil 314 in the direction that moves the actuator 216 to the closed position during joining of the contacts 232, 234, bouncing of the moveable contact 234 is kept to a minimum. Continuing to apply such current to the actuator 216 when the actuator is in the closed position keeps the contacts 232, 234 clamped shut. After a predetermined period of time, the electrical current applied to the coil 314 is removed. The duration of time that current is applied in this phase depends on the characteristics of the actuator 216. After the current is removed, a residual magnetic field remains. Eventually that magnetic field dissipates and the armature 330 is held in place by the permanent magnet 310.

Figures 3D, 3E, 3F:
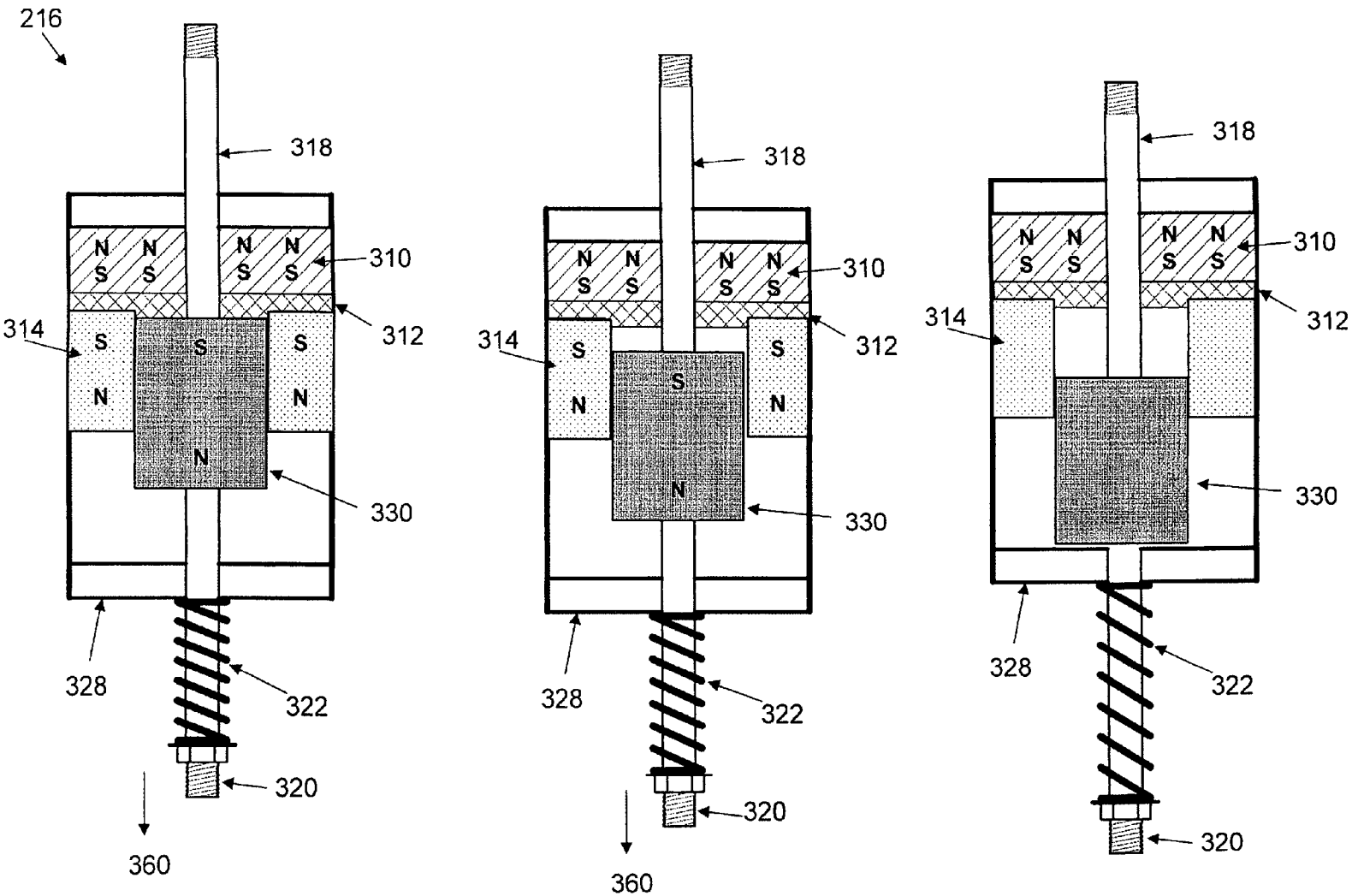
FIG. 3D illustrates an actuator of a power switching device in a closed position prior to moving to the open position.
FIG. 3E illustrates the actuator moving from the closed position to the open position.
FIG. 3F illustrates the actuator in the open position after completing the opening cycle.

FIG. 3D shows the actuator 216 in a closed position. In order to start opening the actuator 216, current is fed through the coil 314 in a second direction that is opposite to the first direction of current flow that was used to close the contacts 232, 234. This second or reverse direction of current flow creates a magnetic field in coil 314 that has a polarity that is opposite the polarity described for FIGS. 3A-C. As the magnetic field grows, it polarizes the armature 330. The magnetic polarity of the armature 330 is now reversed with respect to the polarity shown in FIG. 3C. The reversal of the magnetic polarity of the armature 330 repulses the armature 330 away from the permanent magnet 310 and the armature 330 moves in a downward direction 360. The force necessary to break the magnetic coupling between the armature 330 and the permanent magnet 310 is assisted by the opening spring 322. The amount of current required to open the actuator 216 may be less than the amount of current required to close the actuator 216 depending on the strength of the opening spring 322 and other characteristics of the actuator 216. It is desirable to move the armature 330 in the downward direction 360 with sufficient force to keep the arcing of the contacts 232, 234 to a minimum.

FIGS. 3E and 3F show the actuator 216 completing the opening cycle. Once the armature 330 is moving (FIG. 3E), the opening spring 322 may not provide enough force to keep the armature moving in a downward direction 360. In this case, additional reverse current is applied in order to complete the opening process. In FIG. 3F, the actuator 216 has completed the opening cycle and is in an open position with no current flowing through the coil 314.

Figure 4A:
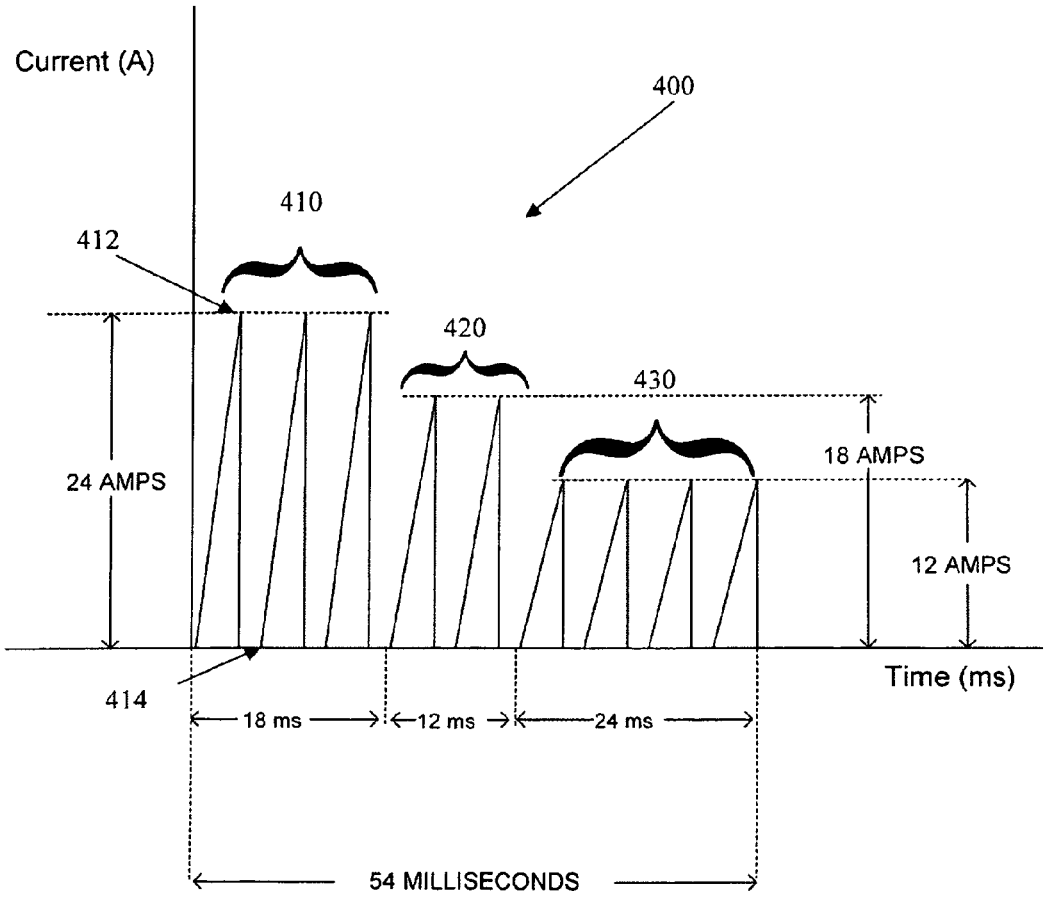
FIG. 4A illustrates a modulated waveform used to close an actuator in accordance with the present invention.

FIG. 4A shows a closing current waveform 400 associated with one embodiment of the present invention for an exemplary actuator moving from an open position to a closed position. The Y-axis of FIG. 4A is the amount of current applied to the coil 314 of the actuator 216 in amperes. The X-axis is the amount of time the current is applied to the coil 314 in milliseconds. The closing waveform 400 comprises three sets of current pulses. The closing current pulses are grouped into first period 410, second period 420 and third period 430.

The pulses for all three close periods 410, 420, and 430 are sent by the controller 112 to the coil 314 of the actuator 216 located in the power switching device 110. The pulses in the first period 410 correspond to the current waveform applied to the coil 314 in order to start the actuator 216 moving from an open position to a closed position (shown in FIG. 3A). The pulses in the close second period 420 are applied to the coil 314 while the actuator 216 is in motion (FIG. 3B). The current pulses of the close third period 430 are transmitted by the controller 112 to the coil 314 after the actuator 216 has closed (FIG. 3C).

As shown in FIG. 4A, once the maximum value of 24 amperes is reached during the first current pulse in the close first period 410, the controller 112 stops the flow of current at time 412. The current remains off for a predetermined delay time and then the second current pulse is initiated at time 414. In the embodiment shown in FIG. 4A, the time delay is 2 ms and is the same for all three close periods 410, 420 and 430. At the end of the close first period 410 the resulting magnetic attraction causes the armature 330 to move towards the permanent magnet 310.

After the last current pulse in the close first period 410, the controller 112 waits for the time delay to expire before transmitting the first pulse in the close second period 420. In the close second period 420, the maximum current applied to the coil 314 is 18 amperes. The time duration of the close second period 420 12 ms. In FIG. 4A, two current pulses are sent to the coil 314 during the close second period 420. At the end of the close second period 420, the contacts 232, 234 are just about to touch or have touched.

The current pulses of the closing waveform 400 shown during the close third period 430 are applied to the coil 314 when the actuator 216 has reached the closed position (FIG. 3C). The time duration for the close third period 430 in FIG. 4A, is 24 ms and the maximum current pulse amplitude is 12 amperes. The current pulses applied to the coil 314 during the close third period 430 keep the armature firmly against the buffer plate and prevents the moveable contact 234 from bouncing. This is referred to as "sealing" the contacts 232, 234.

Figure 4B:
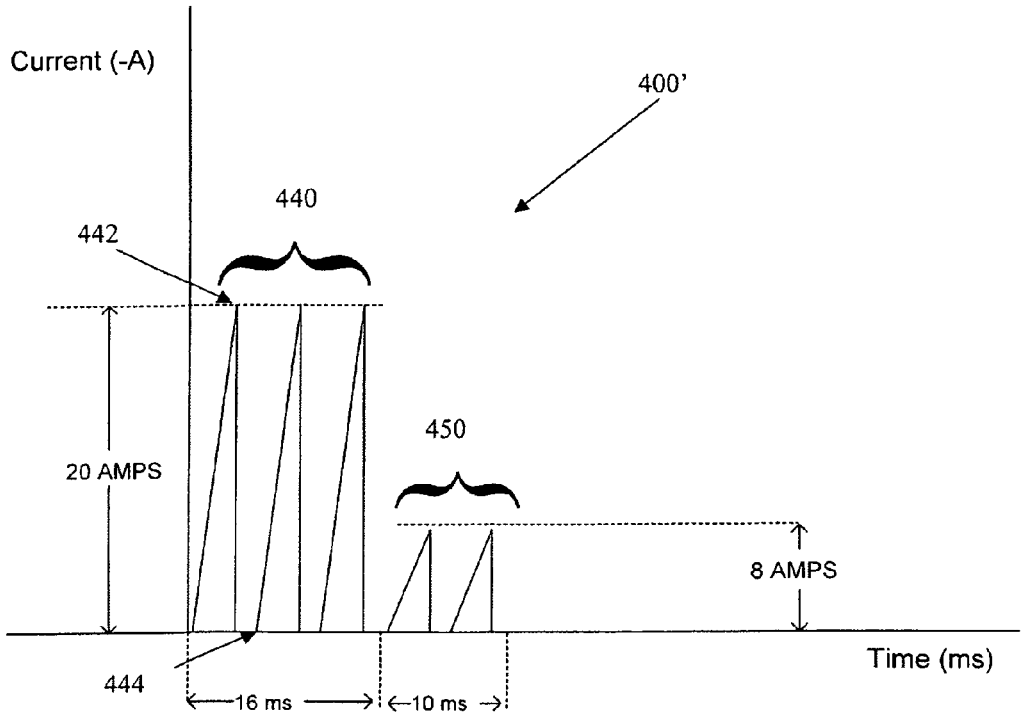
FIG. 4B illustrates a modulated waveform used to open an actuator in accordance with the present invention.

FIG. 4B shows an opening current waveform 400' associated with the present invention. The opening waveform 400' is for an exemplary actuator 216 moving from a closed position to an open position. The Y-axis is the amount of current applied to the coil 314 in negative amperes (opposite direction of the current applied in FIG. 4A). The X-axis is the amount of time the current is applied in milliseconds. The opening waveform 400' has an open first period 440 and an open second period 450. The amplitude of the current pulses in the open first period 440 is negative 20 amperes. The current pulses applied during the open first period 440 of the opening cycle correspond to the current pulses applied to the actuator 216 as shown in FIG. 3D.

The amplitude of the current pulses in the open second period 450 is negative 8 amperes and the time duration for the open second period 450 is 10 ms. The current pulses applied during the open second period 450 of the opening waveform 400' correspond to the current pulses applied to the actuator 216 as shown in FIG. 3E. Once the open second period 450 has completed, no additional current is applied to the coil 314. The opening spring 322 provides the energy necessary to complete the opening cycle of the actuator 216.

The waveforms 400, 400' are configured by a user 118 who programs the waveform configuration information into the controller 112 through the user interface 116. The values programmed for the waveforms 400, 400' are chosen based on the coil inductance as well as the armature response for a particular actuator 216. Other factors taken into account when choosing these values include but are not limited to, the inertial force of the actuator 216, frictional forces acting on the armature 330, and operating conditions such as temperature and humidity and strength of the opening spring 322. The recloser manufacturer may recommend values to be programmed for the waveforms 400, 400'.

The waveforms 400, 400' are sent to the power switching device 110 by the controller 112 through the bidirectional communications bus 114. Four examples of controllers 112 that can be used with a power switching device 110 are the ISD (Intelligent Switching Device), the ICD (Intelligent Control Device), SCD (Switch Control Device) or the PCD (Programmable Control Device). All of these controllers are sold by ABB Inc. The controllers may be configured as an individual controller 112 as illustrated in FIG. 1A, or in a tandem configuration as shown in FIG. 1B. In one embodiment, the controller 112 forms the pulses by discharging a large capacitor (not shown). In another embodiment, the pulses are formed by discharging a bank of capacitors (not shown). In yet another embodiment, a battery (not shown) provides the current for the current pulses. A power supply (not shown) provides power to the controller 112 as well as the power necessary to charge either the capacitors or the battery.

Figure 5:
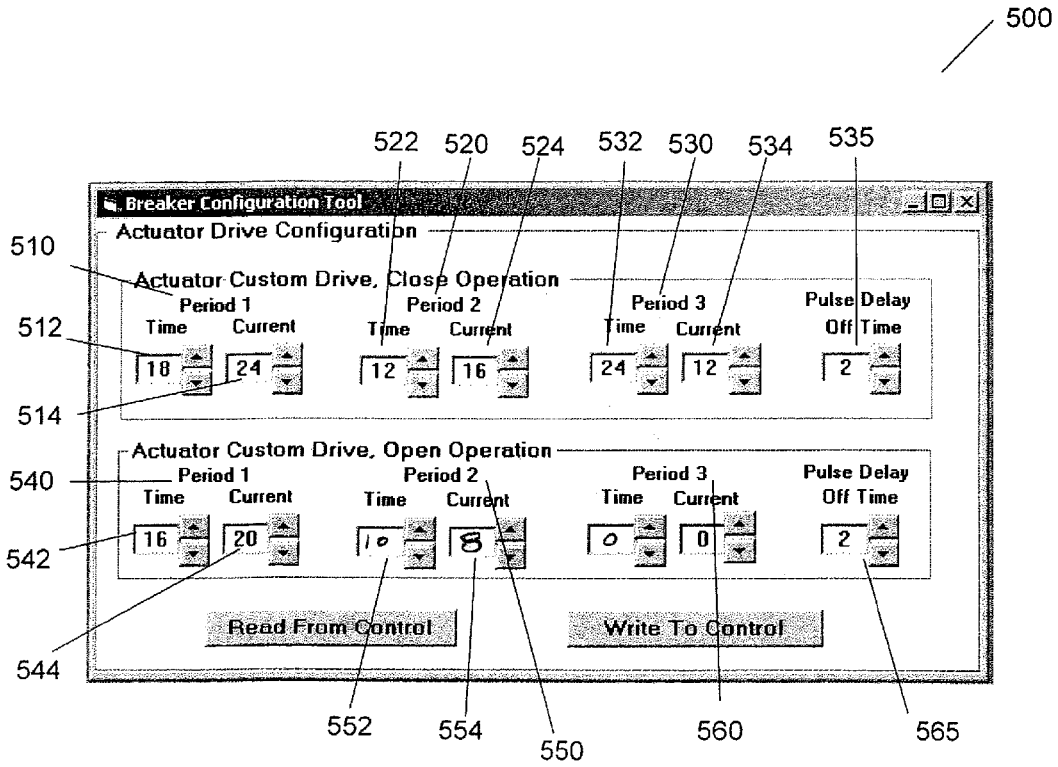
FIG. 5 illustrates a configuration screen associated with a controller used to program the modulated waveform shown in FIGS. 4A and 4B.

FIG. 5 is an illustrative configuration screen 500 associated with the present invention. The configuration screen 500 is displayed to the user 118 by the user interface 116. When the user 118 invokes the application software, a main interface screen (not shown) is displayed. The configuration screen 500 is accessed from the main interface screen. From the configuration screen 500, the user 118 can configure both the closing waveform 400 and the opening waveform 400'. For the closing waveform 400, the actuator Close Operation Period 1 510 corresponds to the close first period 410 of FIG. 4A. The current pulse amplitude 514 is programmed in the window labeled "Current" and the length of the period 512 is programmed in the window labeled "Time."

Close Operation Period 2 520 corresponds to the close second period 420 as shown in FIG. 4A. The current pulse amplitude 524 and period length 522 for Close Operation Period 2 520 are entered in the configuration screen 500. For Close Operation Period 3 530, the waveform configuration information is entered as a current pulse amplitude 534 and pulse length 532. The information programmed for Close Operation Period 3 530 corresponds to the close third period 430 in FIG. 4A.

As discussed previously, the time delay is the amount of time between the end of one current pulse and the start of another. For the actuator close cycle, this is programmed at a close pulse delay time 535. For the embodiment described in FIG. 4A, the time delay is 2 milliseconds.

The open waveform configuration information consists of three open periods 540, 550 and 560. For Open Operation Period 1 540, the current pulse amplitude is programmed at 544. The time duration for Open Operation Period 1 is programmed at 542. The values for Open Operation Period 1 correspond to the values displayed in FIG. 4B at 440. For Open Operation Period 2 550, the current pulse is programmed at 554. and the time duration is programmed at 552. The values for Open Operation Period 2 550 correspond to the values displayed in FIG. 4B at 450. In this example, the values for Open Operation Period 3 560 are set to zero. The time delay for the opening waveform 400' is programmed at 565.

In another embodiment of the present invention, the controller 112 provides the ability to alter the waveforms 400, 400' sent to the actuator 216 after being programmed by the user 118. This feature, referred to as the automatic update, is performed by the microprocessor in the controller 112. The microprocessor is programmed with software code to monitor the operating conditions at the power switching device 110. When the software code determines that the operating conditions are no longer within predefined parameters, the software executes a subroutine to modify the values of the current pulses sent by the controller 112. The software program takes into consideration the real time operating conditions and has decision logic to determine the appropriate changes based on the operating conditions. For example, should the ambient temperature at the power switching device 110 drop below 0° F., the amplitude of the electrical current pulses for the close first period 510 is increased from 24 amperes to 26 amperes. In another example, the subroutine alters the close time delay 535 to 3 ms if the humidity level exceeds 65% relative humidity. The microprocessor is programmed to modify either waveform 400, 400' depending on the operating conditions.

The subroutine modifies the waveforms 400, 400' without any human intervention once the feature has been enabled. The feature is enabled in the initial setup of the controller 112 by the user 118. The automatic update feature allows the controller 112 to operate the power switching device 110 using waveforms 400, 400' that operate the power switching device 110 more efficiently. However, should a utility company decide that only specified values are to be used for a power switching device 110, this feature may be disabled.

The microprocessor software is programmed to be compatible with various types of power switching devices 110 as well as different power switching device manufacturers. To facilitate the various power switching devices 110, the microprocessor software may be programmed to automatically query the power switching device for information such as the manufacturer, type, rating and so forth. Within the software code, a look up table contains guidelines to determine how to modify the waveforms 400, 400' based on the information received from the power switching device 110. Alternatively, the software code may be programmed to allow the user 118 to determine the guidelines for the power switching device 110.

Figure 6A:
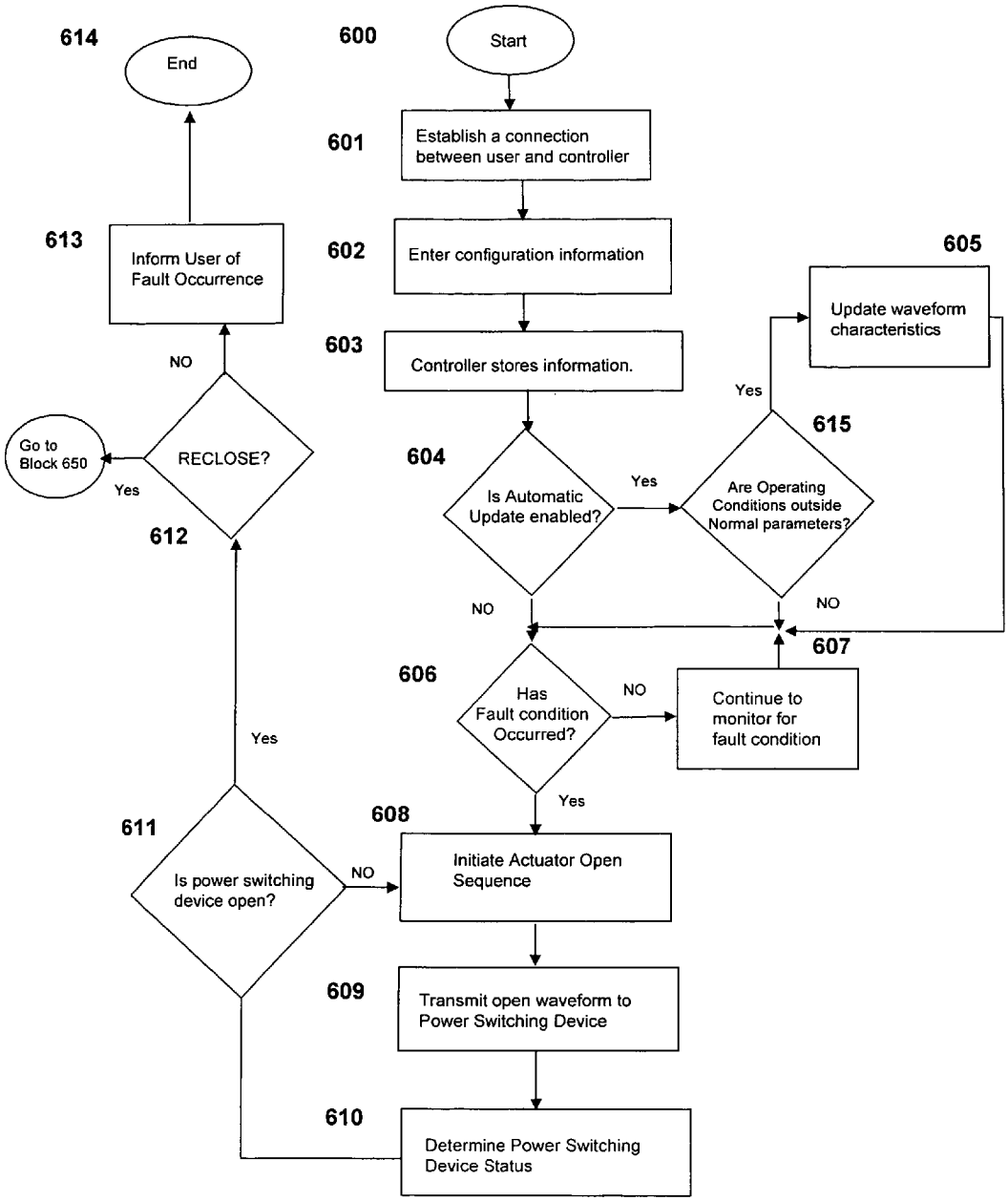
FIG. 6A is an illustrative flow chart showing the software process used to open the power switching device.

FIG. 6A is an illustrative flow chart showing the steps performed by the controller software in accordance with the present invention. The illustrative example is for a recloser 200 controlled by a PCD. The start of the process is at block 600. The actuator 216 of the recloser 200 is in a closed position and current is flowing through the power switching device 110 in block 600. In block 601, the user 118 establishes a connection from the user interface 116 to the controller 112 using the communication means 122. Once this is accomplished, configuration information, such as the waveform parameters shown in FIG. 5, is programmed into controller 112 in block 602. As described previously, the user 118 accesses the appropriate configuration page 500 in the user interface 116. Configuration information is programmed as part of a GUI (Graphical User Interface) as illustrated in FIG. 5. Alternatively, the configuration information may be programmed via a basic text information screen. In block 603, the controller software saves the configuration information into the controller memory. In decision block 604, the software determines if the automatic update feature is enabled. If the feature is enabled, the determination is made if the operating conditions at the power switching device 110 are outside of the normal operating parameters in decision block 615. If the conditions are within set programmed guidelines for the recloser, the next step is to monitor for a fault condition in block 606. If the operating conditions are outside the guidelines, the waveform 400' is updated as shown in block 605. From block 605, the next step is to monitor for the fault condition in block 606.

If the automatic update feature is not enabled in block 604, the controller software monitors the recloser 200 for a fault condition in block 606. If the fault condition has not occurred, then in block 607 the controller software continues to monitor for the fault condition to occur. If the fault condition occurs, the controller initiates the actuator open sequence in block 608. The next block 609 is the transmission of the open waveform 400' from the controller 112 to the power switching device 110. After performing the task at block 609, the actuator 216 should be in an open position. Block 610 shows the controller 112 determining the status of the power switching device 110 by accessing the information provided by the micro switch 226. The recloser relays the micro switch information via the bidirectional communications bus 114 to the PCD. If the actuator 216 did not open, the decision block 611 takes the flow back to restarting the actuator opening sequence of block 608. If the actuator 216 opened, the next step is decision block 612. In block 612, the controller software determines if the recloser is to proceed to block 650 of FIG. 6B and attempt to reclose or proceed to block 613. If the recloser has attempted to close a predetermined number of attempts, the process proceeds to block 613. The number of attempts is programmed using the user interface 116. In block 613, the user 118 is notified of the fault condition and that the recloser is in a lock out state. Once the user 118 has received notification of the fault condition, the controller software proceeds to block 614 and awaits further user instructions.

Figure 6B:
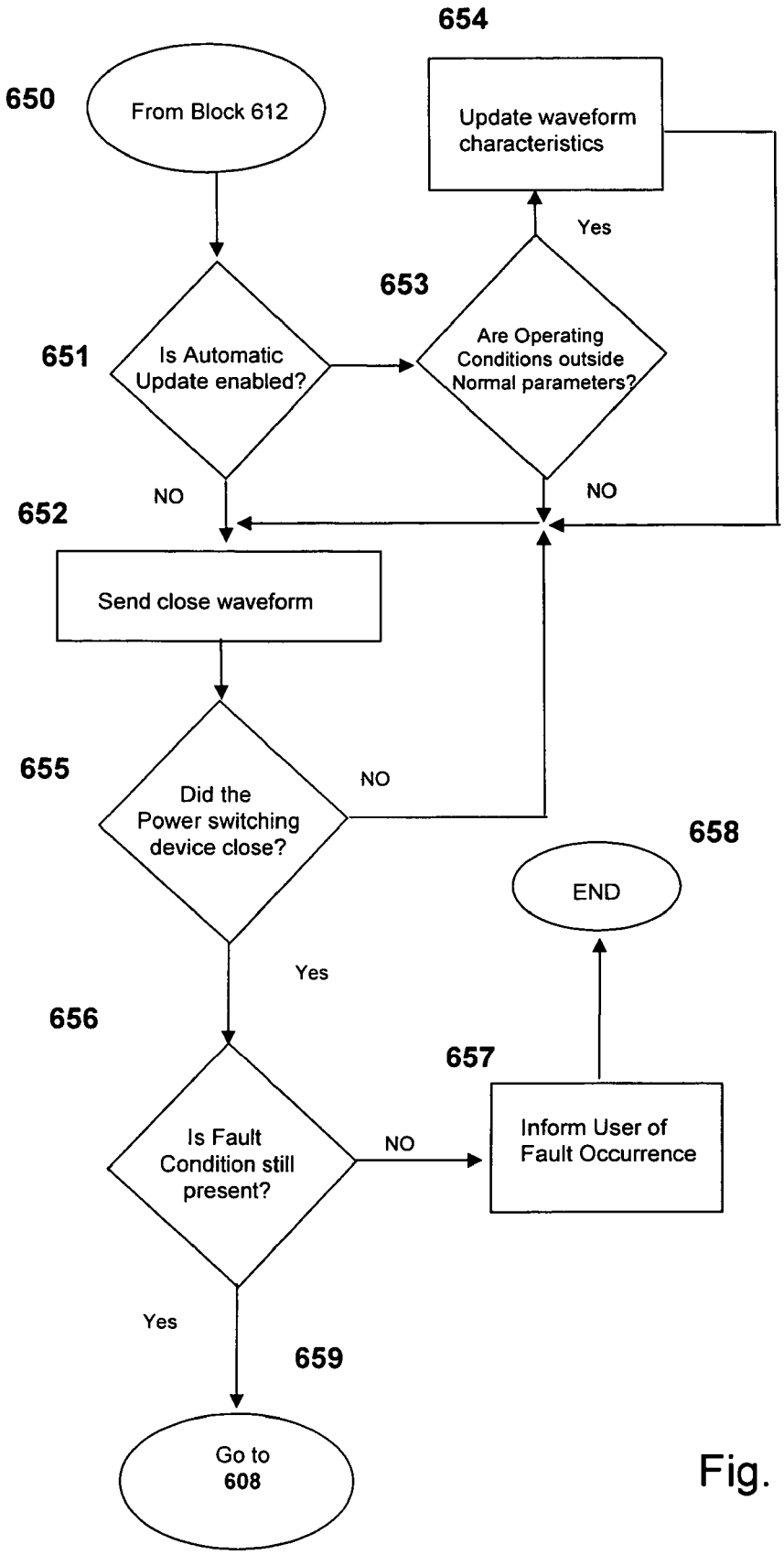
FIG. 6B is an illustrative flow chart showing the software process used to close the power switching device.

FIG. 6B illustrates a closing sequence flow chart in accordance with the present invention. The closing sequence occurs after the opening sequence as described in FIG. 6A has completed. Block 650 is the continuation of decision block 612. The next step in the close sequence is decision block 651. Decision block 651 determines if automatic update feature has been enabled. If the automatic update feature has been enabled, the next step is decision block 653; otherwise the flow continues on to block 652. In decision block 653, the controller software determines if the operating parameters for the recloser are out of the normal preprogrammed parameters. If the conditions are within the normal range, the flow continues to block 652. If the conditions are no longer within the normal range, the appropriate changes are made to the close waveform 400 and the process continues on to block 652.

In block 652, the close waveform 400 is sent from the controller 112 to the power switching device 110. In this illustrative example, the PCD sends the close waveform 400 to the recloser 200. The next step is decision block 655. In block 655, the controller software determines if the power switching device 110 is closed. If the recloser is not in the closed position, the controller software attempts to close the power switching device 110 by resending the close waveform 400. If the power switching device 110 has closed, the next step is decision block 656. In block 656, the controller software determines if the fault condition is still present. If the controller software determines that the fault condition is still present, the next step is back to block 608 of the open sequence of FIG. 6A. If the fault condition is no longer present, the controller software informs the user 118 via the user interface 116 that the fault has occurred in block 657 and the process stops at block 658.

It is to be understood that the foregoing description has been provided merely for the purpose of explanation and is in no way to be construed as limiting of the invention. Where the invention has been described with reference to embodiments, it is understood that the words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

We claim:

1. A method of operating a magnetic actuator in a power distribution switching device, the magnetic actuator having a coil and an armature movable between first and second positions in response to current being provided to the coil, the method comprising:

providing a controller with memory;

providing a user interface;

displaying a screen on the user interface;

receiving first and second current levels that are input into the screen;

receiving a time delay that is input into the screen;

transmitting the first and second current levels to the controller;

transmitting a plurality of first current pulses from the controller to the coil of the actuator during a first time period, each of the first current pulses extending from no current to a current having an amplitude corresponding to the first current level that is received from the screen and each pair of adjacent first current pulses being separated by the time delay that is received from the screen; and transmitting a plurality of second current pulses from the controller to the coil of the actuator during a second time period that is subsequent to the first time period, each of the second current pulses extending from no current to a current having an amplitude corresponding to the second current level that is received from the screen.

2. The method of claim 1, further comprising storing the first and second current levels in the memory of the controller.

3. The method of claim 1, further comprising:

receiving first and second lengths of time that are input into the screen;

transmitting the first and second lengths of time to the controller; and wherein the first time period has the first length of time that is received from the screen, and the second time period has the second length of time that is received from the screen.

4. The method of claim 1, wherein each pair of adjacent second current pulses is separated by the time delay that is received from the screen.

5. The method of claim 4, further comprising:

receiving a third current level that is input into the screen;

receiving a third length of time that is input into the screen;

transmitting the third current level and the third length of time to the controller;

transmitting a plurality of third current pulses from the controller to the coil of the actuator during a third time period that is subsequent to the second time period, each of the third current pulses extending from no current to a current having an amplitude corresponding to the third current level that is received from the screen, and the third time period having the third length of time that is received from the screen.

6. The method of claim 5, wherein the first current level, the second current level, the third current level, the first length of time, the second length of time, the third length of time and the pulse delay time, are input into different sections of the screen, respectively.

7. The method of claim 6, wherein the first, second and third current pulses cause the coil to apply forces to the armature that are in a direction from the second position toward the first position.

8. The method of claim 7, further comprising:

receiving fourth and fifth current levels that are input into the screen;

transmitting the fourth and fifth current levels to the controller;

transmitting a plurality of fourth current pulses from the controller to the coil of the actuator during a fourth time period, each of the fourth current pulses extending from no current to a current having an amplitude corresponding to the fourth current level that is received from the screen;

transmitting a plurality of fifth current pulses from the controller to the coil of the actuator during a fifth time period that is subsequent to the fourth time period, each of the fifth current pulses extending from no current to a current having an amplitude corresponding to the fifth current level that is received from the screen; and wherein the fourth and fifth current pulses cause the coil to apply forces to the armature that are in a direction from the first position toward the second position.

9. A control system for operating a magnetic actuator in a power distribution switching device, the magnetic actuator having a coil and an armature movable between first and second positions in response to current being provided to the coil, the control system comprising:

a controller with memory; and a user interface connected to the controller and operable to display a screen having a first input area, a second input area and a delay input area, the user interface being further operable to receive a time delay in the delay input area and first and second current levels in the first and second input areas, respectively, and to transmit the time delay and the first and second current levels to the controller; and wherein the controller is operable to save the first and second current levels in the memory and to:

transmit a plurality of first current pulses to the coil of the actuator during a first time period, each of the first current pulses extending from no current to a current having an amplitude corresponding to the first current level that is received in the first input area of the screen and each pair of adjacent first current pulses being separated by the time delay that is received from the screen; and transmit a plurality of second current pulses to the coil of the actuator during a second time period that is subsequent to the first time period, each of the second current pulses extending from no current to a current having an amplitude corresponding to the second current level that is received in the second input area of the screen.

10. The control system of claim 9, wherein the first and second input areas of the screen each comprise a current section and a time section, wherein the user interface is operable to receive the first and second current levels in the current sections of the first and second input areas, respectively, and is operable to receive first and second lengths of time in the time sections of the first and second input areas, respectively;

wherein the user interface is operable to transmit the first and second lengths of time to the controller;

wherein the first and second lengths of time are saved in the memory of the controller; and wherein the first time period during which the first current pulses are transmitted to the coil of the actuator has the first length of time that is received in the time section of the first input area of the screen, and wherein the second time period during which the second current pulses are transmitted to the coil of the actuator has the second length of time that is received in the time section of the second input area of the screen.

11. The control system of claim 10, wherein the screen further comprises third, fourth and fifth input areas, each having a current section and a time section;

wherein the user interface is operable to receive third, fourth and fifth current levels in the current sections of the third, fourth and fifth input areas of the screen, respectively;

wherein the user interface is operable to receive third, fourth and fifth lengths of time in the time sections of the third, fourth and fifth input areas of the screen, respectively;

wherein the user interface is operable to transmit the third, fourth and fifth current levels and the third, fourth and fifth lengths of time to the controller; and wherein the controller is operable to save the third, fourth and fifth current levels and the third, fourth and fifth lengths of time in the memory, and wherein the controller is operable to:

transmit a plurality of third current pulses to the coil of the actuator during a third time period that is subsequent to the second time period, each of the third current pulses having an amplitude corresponding to the third current level that is received in the current section of the third input area of the screen, and the third time period having the third length of time that is received in the time section of the third input area of the screen; and transmit a plurality of fourth current pulses to the coil of the actuator during a fourth time period, each of the fourth current pulses having an amplitude corresponding to the fourth current level that is received in the current section of the fourth input area of the screen, and the fourth time period having the fourth length of time that is received in the time section of the fourth input area of the screen; and transmit a plurality of fifth current pulses to the coil of the actuator during a fifth time period that is subsequent to the fourth time period, each of the fifth current pulses having an amplitude corresponding to the fifth current level that is received in the current section of the fifth input area of the screen, and the fifth time period having the fifth length of time that is received in the time section of the fifth input area of the screen.

12. The control system of claim 11, wherein the first, second and third current pulses cause the coil to apply forces to the armature that are in a direction from the second position toward the first position; and wherein the fourth and fifth current pulses cause the coil to apply forces to the armature that are in a direction from the first position toward the second position.

13. The control system of claim 9, wherein the controller is operable to automatically change the first current level when there is a change in the environmental conditions at the power switching device.

14. The method of claim 8, wherein the movement of the armature from the second position to the first position causes the power distribution switching device to move from an open position to a closed position, and the movement of the armature from the first position to the second position causes the power distribution switching device to move from a closed position to an open position.

15. The control system of claim 12, wherein the movement of the armature from the second position to the first position causes the power distribution switching device to move from an open position to a closed position, and the movement of the armature from the first position to the second position causes the power distribution switching device to move from a closed position to an open position.

16. The method of claim 1, wherein the first and second current pulses are first and second closing current pulses, respectively, which cause the power distribution switching device to move from an open position toward a closed position, and wherein the method further comprises:

receiving first and second opening current levels that are input into the screen;

transmitting the first and second opening current levels to the controller;

transmitting a plurality of first opening current pulses from the controller to the coil of the actuator during a first opening time period, each of the first opening current pulses extending from no current to a current having an amplitude corresponding to the first opening current level that is received from the screen;

transmitting a plurality of second opening current pulses from the controller to the coil of the actuator during a second opening time period that is subsequent to the first opening time period, each of the second opening current pulses extending from no current to a current having an amplitude corresponding to the second opening current level that is received from the screen; and wherein the first and second opening current pulses cause the power distribution switching device to move from the closed position toward the open position.

* * * * *